US010843238B1

(12) United States Patent
King

(10) Patent No.: US 10,843,238 B1
(45) Date of Patent: Nov. 24, 2020

(54) HOLE CLEANING APPARATUS

(71) Applicant: Frederick King, Denison, TX (US)

(72) Inventor: Frederick King, Denison, TX (US)

( * ) Notice: Subject to any disclaimer, the term of this patent is extended or adjusted under 35 U.S.C. 154(b) by 0 days.

(21) Appl. No.: 16/381,231

(22) Filed: Apr. 11, 2019

(51) Int. Cl.

| | |
|---|---|
| ***B08B 9/045*** | (2006.01) |
| ***B08B 9/027*** | (2006.01) |
| ***B08B 9/087*** | (2006.01) |
| ***B08B 9/04*** | (2006.01) |
| ***B08B 9/043*** | (2006.01) |
| ***B08B 9/08*** | (2006.01) |

(52) U.S. Cl.
CPC ..... *B08B 9/045* (2013.01); *B08B 9/027* (2013.01); *B08B 9/04* (2013.01); *B08B 9/0436* (2013.01); *B08B 9/087* (2013.01); *B08B 9/0808* (2013.01); *B08B 2209/04* (2013.01)

(58) Field of Classification Search
CPC . F41A 29/02; B08B 9/027; B08B 9/04; B08B 9/043; B08B 9/0436; B08B 9/045; B08B 9/0808; B08B 9/087; A47L 17/00; A47L 17/04; A47L 17/06; A47L 17/08; A47L 17/10; A47L 25/12
USPC ..... 15/104.095, 104.096, 104.11, 104.16, 15/104.165, 101, 211–213, 147.1, 147.2, 15/149, 150, 154; 42/95
See application file for complete search history.

(56) References Cited

U.S. PATENT DOCUMENTS 116,121 A * 6/1871 Ward ..... 15/147.2
336,746 A * 2/1886 Reisor ..... 15/211
490,374 A * 1/1893 Teeple ..... 15/149
1,433,326 A * 10/1922 Wolfe ..... A47K 7/028 15/244.1
1,752,896 A * 4/1930 Deubener ..... A47L 17/00 15/147.2
1,978,748 A * 10/1934 Gregory ..... A47L 17/00 15/229.3
2,151,425 A * 3/1939 Gregory ..... A47L 17/00 15/118

(Continued)

*Primary Examiner* — Mark Spisich

(74) *Attorney, Agent, or Firm* — Sanchelima & Associates, P.A.; Christian Sanchelima; Jesus Sanchelima

(57) ABSTRACT

A hole cleaning apparatus is disclosed. The apparatus comprises an elongated member, a looped member, a hook type fastener member and a plurality of cleaning members. The looped member extends from the elongated member and the hook type fastener member extends from the looped member. The looped member comprises a loop to detachably receive at least one of a plurality of cleaning members and the hook type fastener member fastens the looped member to the elongated member. The looped member and the hook type fastener member are configured to securely hold the cleaning member in place. The elongated member, looped member and hook type fastener member form a unitary body. The hole cleaning apparatus is configured to detachably couple with a rotary drive member to provide rotational motion. The rotary drive member is configured to rotate the plurality of cleaning members to clean a hollow object. The rotary drive member could be any device configured to provide rotational motion. The apparatus could be used in paint body shops, machine shops, automotive shops, millwrights, chemical plants, power plants and various manufacturing fields, and by end users such as mechanics, maintenance personnel, plumbers, etc.

9 Claims, 3 Drawing Sheets

(56) References Cited

U.S. PATENT DOCUMENTS

| | | | | | |
|---|---|---|---|---|---|
| 2,550,734 | A | * | 5/1951 | Thompson | A47L 13/46<br>15/145 |
| 2,682,073 | A | * | 6/1954 | Hoffman | A47L 17/00<br>15/244.1 |
| 3,220,040 | A | * | 11/1965 | Knaebe | A47K 7/028<br>15/244.1 |
| 5,033,155 | A | | 7/1991 | Klotz | |
| 5,806,128 | A | | 9/1998 | Love | |

* cited by examiner

HOLE CLEANING APPARATUS

BACKGROUND OF THE INVENTION

1. Field of the Invention

The present disclosure relates to a cleaning apparatus. More specifically, the present disclosure relates to a hole or any hollow body cleaning apparatus adapted to clean holes of different sizes.

2. Description of the Related Art

Conventional cleaning apparatus comprises a handle equipped with a cleaning head of brushes or other bristle-type structures at one end that are used to effectuate the cleaning process. Such cleaning apparatus exhibit an unsatisfactory cleaning ability because of their largely rigid construction and design of the cleaning head, which is most noticeable where narrow or deformed hollow bodies are to be cleaned. Furthermore, such brushes become unusable after certain period of wear. In addition, the cleaning apparatus of different size need to be purchased and changed constantly to clean various sized holes. This process is time-consuming, tedious with physically repetitive motions, and may lead to undesired results.

Several devices have been designed in the past. None of them, however, include a hole cleaning apparatus that is capable of addressing the foregoing discussed issues.

Applicant believes that a related reference corresponds to U.S. Pat. No. 5,033,155 filed by Manfred Klotz describes a long-handled brush suitable for cleaning hollow bodies. The Manfred reference discloses a long-handled brush suitable for cleaning hollow bodies, e.g. drinkware, bottles, thermos flasks, bowls, vases, etc. The brush comprises a handle and a removable cleaning head. The cleaning head has an elastic core and an outer covering of fell or fell-like material, such as natural sheepskin. A headed bolt is preferably used to attach the cleaning head to the handle, with the bolt extending through a central longitudinal channel in the head. The cleaning head is preferably cylindrical and the handle may be telescopically extendable. However, the Manfred reference is not suitable for application in various manufacturing fields such as machine shops, automotive shops, millwrights, chemical plants, power plants.

Another related reference is U.S. Pat. No. 5,806,128 filed by Georgina I. Love discloses a cleaning tool. The Georgina reference teaches a cleaning tool including a fleece covering and support structures, where both supported by a handle. The fleece material is sewn into a hollow cylinder and then turned inside out. A foam structure surrounds the upper end of the handle as it extends into the hollow fleece cylinder. A foam plug lies within the foam structure and cushions the upper end of the handle against the inside of the fleece material. Near the point of entry of the handle into the foam structure, the fleece material is attached to the handle to hold the cleaning tool together. Various shapes of cleaning tool can be formed with the overall outer shape of the fleece dependent upon both the cutting and sewing of the fleece material, as well as the shape of the supporting foam material. However, the Georgina reference requires complex steps to change the foam structure into a shape desired for a particular hole to be cleaned.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a hole cleaning apparatus to clean a wide range of hollow bodies.

It is another object of the present invention to provide a hole cleaning apparatus having a plurality of cleaning members to accommodate holes of different sizes.

It is yet another object of the present invention to provide a hole cleaning apparatus comprising an elongated member, a looped member, a hook type fastener member and a plurality of cleaning members, wherein the looped member comprises a loop to detachably receive at least one of a plurality of cleaning members and the hook type fastener member fastens the looped member to the elongated member.

It is yet another object of the present invention to provide a hole cleaning apparatus configured to detachably couple with a rotary drive member, wherein the rotary drive member is configured to rotate the one of a plurality of cleaning members to clean the hollow object.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
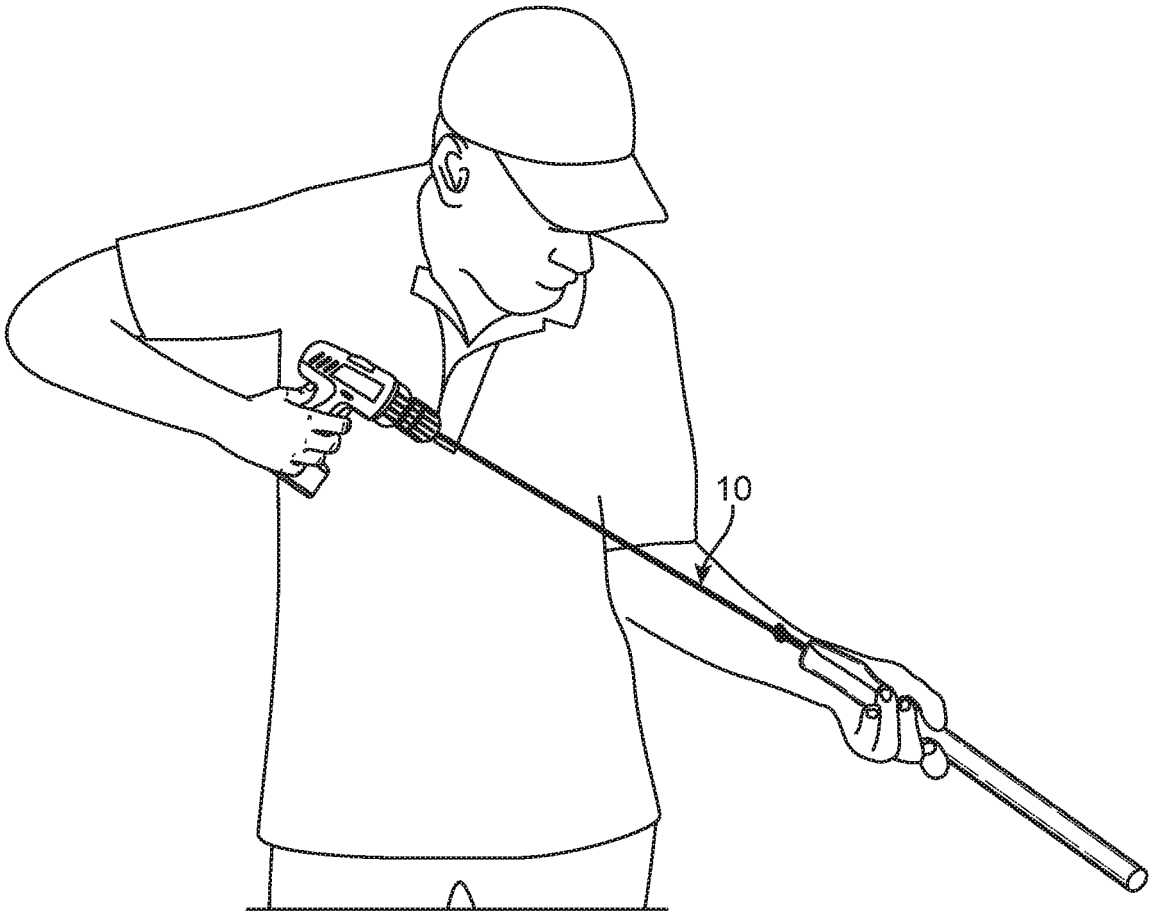
FIG. 1 exemplarily illustrates a user removing debris from a hollow body utilizing a hole cleaning apparatus 10 in an embodiment of the present invention. A rotary drive member rotating the hole cleaning apparatus 10 to clean the hollow object is illustrated.
Figure 2:
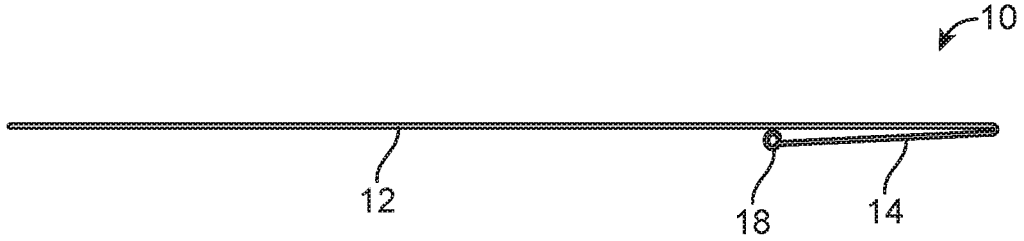
FIG. 2 exemplarily illustrates a side perspective view of the hole cleaning apparatus 10 in an embodiment of the present invention. The hole cleaning apparatus 10 comprising an elongated member 12, a looped member 14, a hook type fastener member 18 is illustrated.
Figure 3:
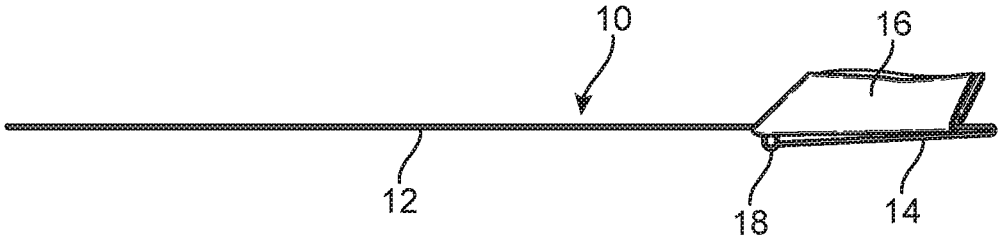
FIG. 3 exemplarily illustrates one of a plurality of cleaning members 16 being inserted within the looped member 14 of the hole cleaning apparatus 10 in another embodiment of the present invention.
Figure 4:
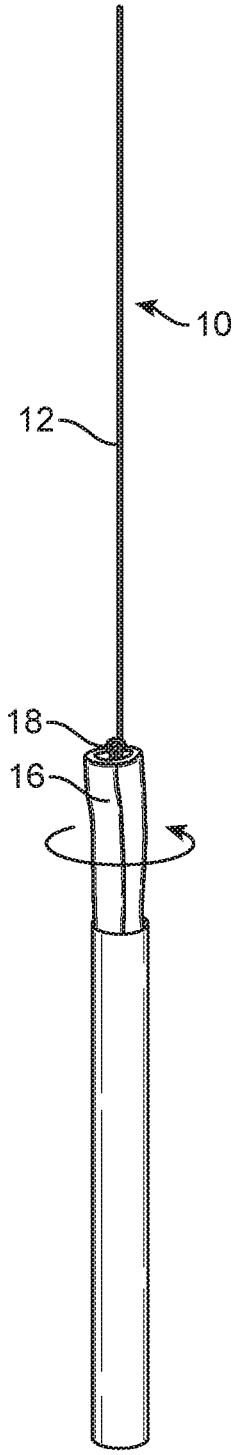
FIG. 4 exemplarily illustrates the hole cleaning apparatus 10 removing debris from a hollow body in an embodiment of the present invention.
Figure 5:
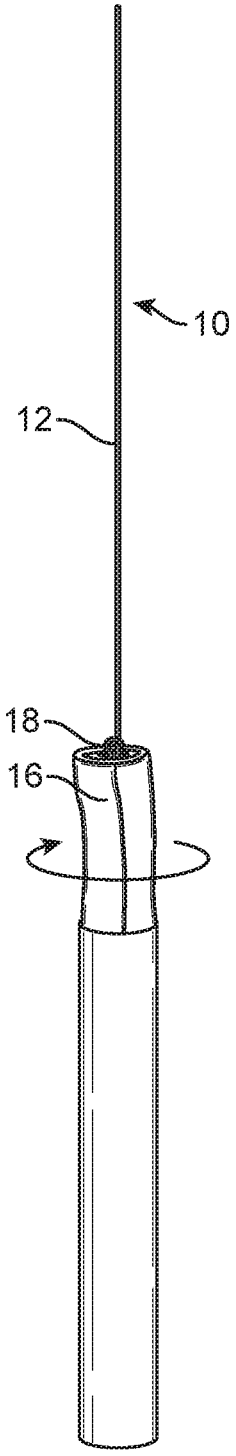
FIG. 5 exemplarily illustrates the hole cleaning apparatus 10 removing debris from a hollow body in an embodiment of the present invention.

Referring now to the drawings, FIGS. 1-5, where the present invention is generally referred with numeral 10, it can be observed that a hole cleaning apparatus 10 adapted to clean a wide range of hollow bodies, is disclosed.

In an embodiment, the hole cleaning apparatus 10 comprises an elongated member 12, a looped member 14 and one of a plurality of cleaning members 16. The looped member 14 extends from the elongated member 12. In one embodiment, the elongated member 12 is generally a cylindrical rod. Each of plurality of cleaning members 16 can be of different widths to accommodate holes of different sizes.

The looped member 14 comprises a loop, which is configured to receive one of a plurality of cleaning members 16. The hole cleaning apparatus 10 of the present invention allows detachment of the attached one of a plurality of cleaning members 16 and replacement with another one of a plurality of cleaning members 16, if necessary. The a plurality of cleaning members 16 can be of different sizes to eliminate the need for conventional apparatus of different sizes.

The hole cleaning apparatus 10 further comprises a fastener member extending from the looped member 14. The fastener member is configured to fasten one end of the looped member 14 to the elongated member 12. In one embodiment, the fastener member is a hook type fastener member 18. In another embodiment, the fastener member is at least one of a type including, but not limited to, a snap-fit type fastener, a mechanical fastener or a threaded element. The elongated member 12, looped member 14 and hook type fastener member 18 form a unitary body. The hole cleaning apparatus 10 is configured to detachably couple with a rotary drive member to provide rotational motion. The rotary drive member is configured to rotate the plurality of cleaning members 16 to clean the hollow object. The rotary drive member could be any device configured to provide rotational motion.

In one embodiment, the plurality of cleaning members 16 can be constructed from a material including, but not limited to, scouring pad, cleaning pad or foam pad. In another embodiment, the plurality of cleaning members 16 can be adapted to clean any type of unwanted particles, including, but not limited to, debris, sealant, gasket glue, oil, and grease. In one embodiment, the plurality of cleaning members 16 can be made of natural or synthetic materials, or combinations thereof, including but not limited to nylon, plastic, polymers, rubber. In one embodiment, the plurality of cleaning members 16 can be cylindrical in shape. In other exemplary embodiments, the plurality of cleaning members 16 may be of other shapes such as, for example, square, triangular, circular, semi-circular, oval, or any other polygonal shape.

In one embodiment, the hole cleaning apparatus 10 comprising the elongated member 12, looped member 14 and fastener member is made of any type of rigid material, including, but not limited to, steel, polymer, and metal. In another embodiment, the apparatus 10 can be 24" in length. In yet another embodiment, the cleaning member 16 can be 7" in length. In yet another embodiment, the plurality of cleaning members 16 can be ½" in width, the fastener member can be ¾" in width and the elongated member 12 can be ⅛" in width. In yet another embodiment, the material, scrubber type, shape and dimension of the apparatus 10 may vary based on the need of an end user.

Advantageously, the present invention is configured to clean a wide range of hollow bodies. The present invention eliminates the need of many tools for cleaning hollow bodies of different size. The present invention allows replacement of one of plurality of cleaning members 16 with another of a plurality of cleaning members 16, if necessary. The hole cleaning apparatus 10 could be used to clean out head bolt holes and in every industry that has pipes. The hole cleaning apparatus 10 could be used in paint body shops, machine shops, automotive shops, millwrights, chemical plants, power plants and various manufacturing fields, and by end users such as mechanics, maintenance personnel, plumbers, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hole cleaning apparatus, comprising:

an elongated member having an elongated cylindrical structure with a first end and a second end;

a rotary driver member, wherein said second end of said elongated member is communicably engaged with said rotary drive member, said rotary drive member providing a rotational motion to said elongated member;

a looped member extending from said first end of said elongated member forming a closed loop, and a cleaning member, wherein said cleaning member is detachably disposed on said loop, wherein said cleaning member has a cylindrical shape, said cleaning member wrapping entirely around said lopped member, wherein said cleaning member is selected from a group consisting of a scouring pad, a cleaning pad or a foam pad.

2. The hole cleaning apparatus of claim 1, further comprising a fastener member extending from said looped member.

3. The hole cleaning apparatus of claim 2, wherein said fastener member fastens one end of said looped member to said elongated member.

4. The hole cleaning apparatus of claim 2, wherein said fastener member is a hook type fastener member.

5. The hole cleaning apparatus of claim 4, wherein said elongated member, said looped member and said hook type fastener member form a unitary body.

6. The hole cleaning apparatus of claim 5 wherein said unitary body is partially inserted into a hollow body.

7. The hole cleaning apparatus of claim 2, wherein said fastener member is selected from a group consisting of a snap-fit type fastener, a mechanical fastener or a threaded element.

8. The hole cleaning apparatus of claim 1 wherein said rotary drive member is a hand operated drill.

9. A system for a hole cleaning implement, consisting of:

a) a hollow body having an interior space, wherein said hollow body is a pipe having a cylindrical shape;

b) a rotary drive member being a hand-operated drill;

c) a long handled rod having a first end and a second end, wherein said long handled rod is an elongated cylindrical structure, wherein said second end is communicably engaged within said rotary drive member;

d) a looped member extending from said first end of said long handled rod, wherein said looped member is bent towards said long handled rod forming a loop, said looped member further including a hook fastening member on a distal most end, said hook fastening member having a circular structure with a cut portion, said hook fastening member being fastened to said long handled rod to form a closed loop;

e) a cleaning member selected from a group consisting of a scouring pad, a cleaning pad, or a foam pad, wherein said cleaning member has a cylindrical shape and is inserted within said loop, said cleaning member locked within said loop through said fastening member, wherein said cleaning member wraps entirely around said looped member, said cleaning member then being partially inserted within said hollow body, wherein said rotary drive member is then engaged to provide a rotational motion to said cleaning member.

* * * * *